United States Patent [19]

Sigler

[11] Patent Number: 4,672,690

[45] Date of Patent: Jun. 16, 1987

[54] VACUUM TANK CONSTRUCTION FOR SELF-CONTAINED SEWAGE HANDLING APPARATUS

[75] Inventor: James Sigler, Perrysville, Ohio

[73] Assignee: Sealand Technology, Inc., Big Prairie, Ohio

[21] Appl. No.: 822,237

[22] Filed: Jan. 24, 1986

[51] Int. Cl.[4] ..... E03D 11/02; E03D 11/18

[52] U.S. Cl. ..... 4/423; 4/318; 4/321; 4/323; 137/577; 210/767

[58] Field of Search ..... 4/321, 319, 318, 323, 4/415, 423, 300, 300.3, DIG. 19, DIG. 14, 255, 431, 434; 137/205; 251/5; 210/167, 767, 194

[56] References Cited

U.S. PATENT DOCUMENTS

| | | | |
|---|---|---|---|
| 3,663,970 | 5/1972 | Drouhard, Jr. et al. | 4/321 X |
| 3,780,757 | 12/1973 | Jordan | 4/321 X |
| 4,242,765 | 1/1981 | Russell | 4/321 |
| 4,332,041 | 6/1982 | Kristoffersen | 4/323 X |
| 4,357,719 | 11/1982 | Badger et al. | 4/323 X |
| 4,521,925 | 6/1985 | Chen et al. | 4/323 X |
| 4,561,132 | 12/1985 | Lew et al. | 4/321 X |

*Primary Examiner*—Henry K. Artis

*Attorney, Agent, or Firm*—Nixon & Vanderhye

[57] ABSTRACT

A sewage treatment system includes a toilet, vacuum tank, and vacuum pump. The toilet has a discharge portion at its bottom, and a foot operated valve selectively allows, or blocks, passage of water and waste from the toilet bowl into the discharge. When the valve is opened in rushing air forces waste and water from the bowl at high velocity so that the waste fragments. The vacuum tank is connected to the toilet discharge and is disposed directly below it, and has an outlet at its bottom and a dome-shaped baffle, with side openings, covering the vacuum tank outlet. A vacuum switch is operatively connected to the vacuum tank and controls the vacuum pump. The pump is operatively connected by a conduit to the vacuum tank outlet. The vacuum tank outlet has a diameter about half the size of that of the vacuum tank inlet.

20 Claims, 2 Drawing Figures

DISPOSAL
10
12
14
15
16
17
20
22
24
25
26
28
30
32
33
34
40
2

VACUUM TANK CONSTRUCTION FOR SELF-CONTAINED SEWAGE HANDLING APPARATUS

BACKGROUND AND SUMMARY OF THE INVENTION

For many different environments, particularly for use in boats and recreational vehicles, it is desirable to provide vacuum toilets. Such systems allow a relatively small volume of flush fluid to be utilized, since it is often difficult to effectively treat, or hold, large volumes of liquid-waste slurrys in such environments. While there have been a number of systems developed which are particularly effective in such environments, such as that shown in U.S. Pat. No. 3,663,970 (the disclosure of which is hereby incorporated by reference herein), in some specialty applications conventional sewage systems with vacuum toilets become clogged up often, requiring constant maintenance and/or resulting in the sewage handling system being rendered ineffective at times when it is greatly needed. For instance on tour boats, and like vessels, oftentimes users of the sewage handling system are unfamiliar with the necessity to prevent large objects from entering the system, and/or simply do not exercise reasonable care in determining what goes into those systems. As a result foreign objects such as soft drink and beer cans, paper cups, wallets, or the like, block or plug the pipe between the tank and the pump, or other components of the system, resulting in the maintenance and/or out-of-service problems mentioned above.

According to the present invention, a sewage handling system is provided which overcomes the drawbacks associated with conventional systems, and allows effective operation, and easy maintenance, of the sewage handling system even in environments, such as tour vessels and the like, where a substantial amount of foreign object material can be expected to enter the sewage treatment system. The invention effectively accomplishes this objective by providing a vacuum tank which is preferably located directly below the discharge from a toilet, having a vaccum valve associated with the discharge. The vacuum tank includes a large cross-sectional area opening at the top thereof, and a much smaller cross-sectional outlet at the bottom thereof. Baffle means are provided within the vacuum tank and operatively surrounding the outlet, and prevent passage of large, non-degraded objects from the vacuum tank toward the pump. Such objects could be soft drink or beer cans, paper cups, and the like.

For easy maintenance, the vacuum tank is preferably connected by quick disconnect couplings to the toilet discharge, and to a conduit leading from the vacuum tank outlet to a vacuum pump. Also, the vacuum tank provides a convenient means for mounting a vacuum switch which controls operation of the vacuum pump. The vacuum switch is in operative communication with the interior of the vacuum tank, and preferably is mounted to the vacuum tank by a quick disconnect coupling, so that it extends generally horizontally outwardly from the vacuum tank, and is disposed adjacent the top of the vacuum tank.

With the sewage handling system according to the invention, a substantial volume of foreign objects are accumulated within the vacuum tank without hindering operations of the sewage system, and then when it is necessary to periodically clean out the vacuum tank, this may be accomplished simply and easily by using the quick disconnect couplings to quickly detach the vacuum tank from the rest of the sewage treatment system, and empty it of its contents (or replace it with a new tank).

It is the primary object of the present invention to provide an improved sewage handling system utilizing a vacuum toilet. This and other objects of the invention will become clear from an inspection of the detailed description of the invention, and from the appended claims.

DETAILED DESCRIPTION OF THE INVENTION

Figures 1, 2:
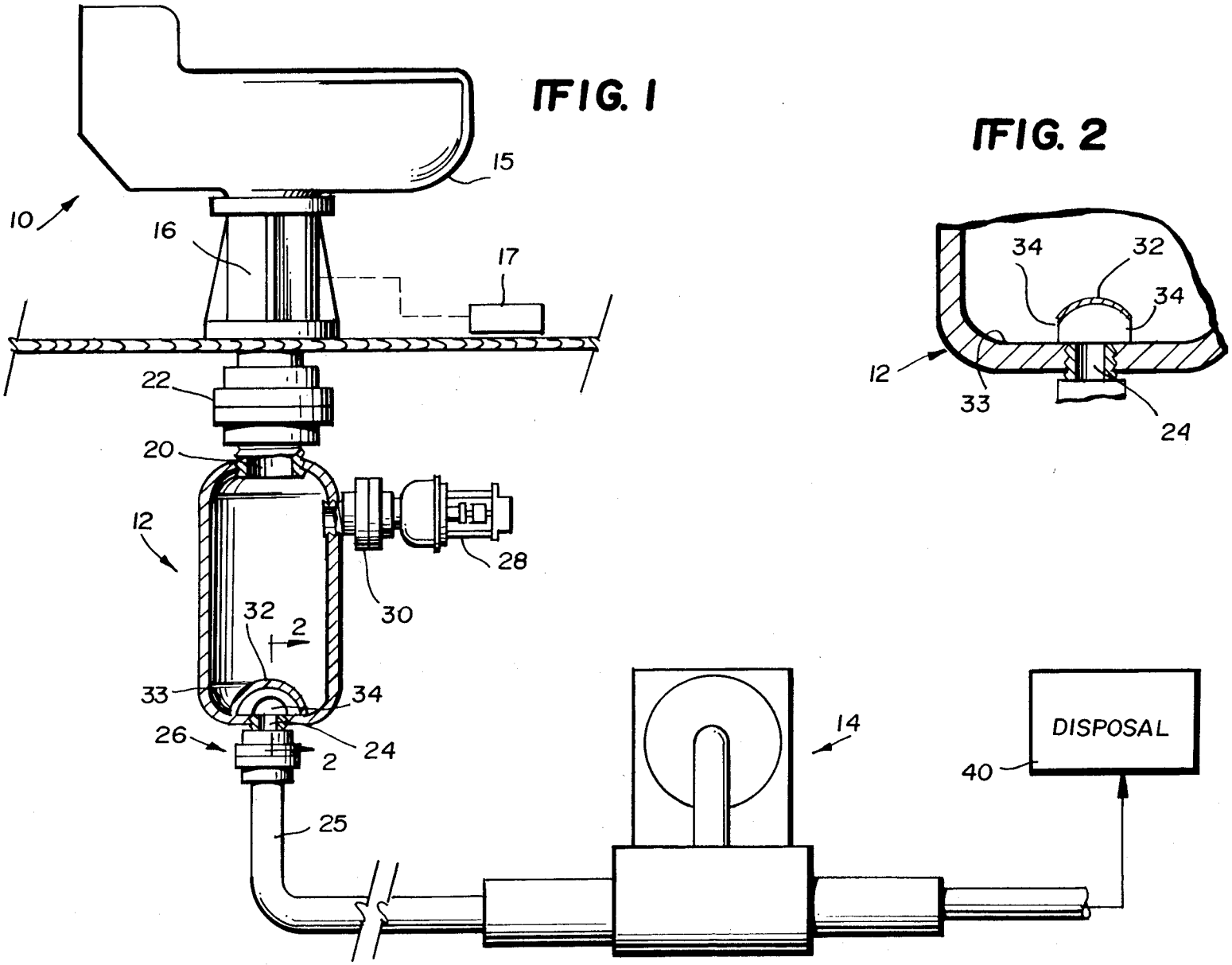
FIG. 1 is a side schematic view of an exemplary sewage handling system according to the present invention, showing most of the components in elevation but showing the vacuum tank in cross-section.
FIG. 2 is a detail cross-sectional view of a portion of the vacuum tank of the system of FIG. 1, taken along lines 2—2 thereof.

The major components of the sewage handling system according to the present invention include the toilet 10, vacuum tank 12, and vacuum pump 14. The toilet 10 includes a bowl 15 with a discharge portion 16 extending downwardly therefrom. At the bottom of the bowl 15 and at the top of the discharge portion 16 is mounted a flush valve. The flush valve may be of any conventional construction but preferably is of the type illustrated and described in U.S. Pat. No. 3,663,970. While the flush valve may be operated by any convenient mechanism, a preferred mechanism is a bi-directional foot operated lever, shown schematically by reference numeral 17 in FIG. 1, which opens the flush valve when moved to one position, and when moved to another position fills the bowl 15 with a small amount of water from a water source (not shown). That is the bi-directional lever 17 takes the form of a control for both the flush valve and the fresh water supply pump illustrated in said U.S. Pat. No. 3,663,970.

The interior diameter of the discharge portion 16 preferably is substantially constant and approximately three inches. When the lever 17 is operated in one direction so as to open the flush valve, in-rushing air forces the waste and water from the bowl through the discharge 16 at a high velocity (e.g. approximately 20 feet per second). This incoming air thus acts on the waste to fragment it as it passes past the flush valve.

The tank 12 is preferably mounted directly below the discharge opening 16, and an inlet 20 to the vacuum tank 12 is connected to the discharge opening 16. This connection is preferably provided by a conventional quick disconnect coupling 22. The vacuum tank 12 also has an outlet 24 disposed in the bottom thereof and operatively connected to a conduit 25 which leads to the vacuum pump 14. Another conventional quick disconnect coupling 26 preferably is provided connecting the outlet 24 to the conduit 25.

The vacuum tank 12 provides a convenient mechanism for mounting a vacuum switch 28. The vacuum switch 28 controls the operation of the vacuum pump 14, either turning it on or off depending upon the degree of vacuum within the tank 12. The vacuum switch 28 is preferably mounted to the tank 12 so that it is in operative communication with the tank 12, and in the manner illustrated in FIG. 1. That is, the vacuum switch 28 extends generally horizontally out from the tank 12 with another quick disconnect coupling 30 being provided between the vacuum switch 28 and the tank 12, and the vacuum switch 28 mounted adjacent the top of the tank 12, as illustrated in FIG. 1.

According to the present invention, means are provided associated with the tank 12 for preventing large, non-degraded objects (such as soft drink and beer cans, paper cups, wallets, and the like) from passing into the conduit 25, and/or toward the vacuum pump 14. The preferred mechanism for accomplishing this function is the baffle means illustrated in FIGS. 1 and 2, which preferably comprises a dome-shaped baffle 32 which has openings at side portions thereof. In the preferred embodiment illustrated in the drawings, it will be seen that the curvature of the dome extends upwardly from the bottom surface 33 of the tank 12 into the interior of the tank, and that a pair of semi-circular-shaped openings 34 are provided, one disposed on either side of the outlet 24, and opposite from each other.

The cross-sectional area of the outlet 24 of the vacuum tank 12 is preferably significantly less than the cross-sectional area of the inlet 20. For instace in the preferred embodiment illustrated in the drawings, the inlet 20 is circular in cross-section and has a diameter of about three inches (the same as that of the discharge 16), while the outlet 24 (also generally circular in cross-section) has a diameter of about 1.5 inches. It is also preferred that the openings 34 be configured so that the maximum effective dimension thereof (in the embodiment illustrated a radius of the semi-circular opening 34, for example) is less than the diameter of the outlet 24.

The provision of the baffle 32 allows the accumulation of a significant number of foreign objects within the vacuum tank 12 without any adverse effect on the operation of the sewage handling system. For example utilizing the invention in an actual commercial tour boat environment for the purposes of testing its effectiveness in real life service conditions, it was possible to provide a sewage handling system which did not malfunction and only required periodic, and easily effected, maintenance—i.e. emptying of the vacuum tank—over a commercially significant period of time.

Once the sewage passes from conduit 25 through the vacuum pump 14, it may be passed to subsequent station 40. The station 40 may be a large holding tank, a treatment facility, or a disposal station, or any combination thereof.

OPERATION

A user of the toilet 10 operates the bi-directional level 17 to fill the toilet bowl 15 with water, such filling requiring only a small amount thereof (e.g. less than three gallons). After depositing waste material in the toilet bowl 15, the user operates the bi-directional level 17 to open the valve between the discharge 16 and the bowl 15. The opening of the valve causes air to rush into the system as a result of the vacuum (negative pressure) conditions that exist in vacuum tank 12, the in-rushing air causing the liquid and waste within the bowl 15 to pass into the tank at high velocity, the waste being fragmented in the process. The fragmented waste and water pass through the openings 34 in the dome-shaped baffle 32, and then through the outlet 24 to the vacuum pump 14, and ultimately to station 40.

The negative pressure within the vacuum tank 12 is controlled by the vacuum switch 28, which senses the pressure within the tank 12 and then controls the vacuum pump 14 so that the pressure within tank 12 is maintained within pre-set desired parameters.

The vacuum tank 12 allows accumulation of a large number of foreign objects therewithin, preventing the passage of the foreign objects into the conduit 25 by the disposition of the baffle 32. When the vacuum tank 12 fills with foreign objects, however, it may easily be maintained by disconnecting it, utilizing quick disconnect couplings 22 and 26, from the rest of the system (and even from the vacuum switch, utilizing quick disconnect coupling 30, if necessary), and emptying or replacing the tank 12.

It will thus be seen that according to the present invention a simple yet effective and versatile sewage handling system for use with a vacuum toilet, has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A sewage handling system comprising:

a toilet having a discharge portion at the bottom thereof;

a vacuum tank connected to said discharge portion of said toilet and having an outlet at the bottom of said vacuum tank;

a vacuum switch operatively connected to said vacuum tank and operatively communicating with the interior thereof;

a vacuum pump operatively connected by a conduit to said vacuum tank outlet, and operatively controlled by said vacuum switch; and baffle means mounted within said vacuum tank and operatively surrounding said vacuum tank outlet, for preventing passage of large, non-degraded objects from said vacuum tank toward said pump.

2. A system as recited in claim 1 wherein said vacuum tank is mounted so that it has an inlet directly below said toilet discharge.

3. A system as recited in claim 2 further comprising quick disconnect couplings between said vacuum tank inlet and said toilet discharge, and between said vacuum tank outlet and conduit between said vacuum tank and said pump.

4. A system as recited in claim 3 wherein said vacuum tank inlet has a cross-sectional area significantly greater than said vacuum tank outlet.

5. A system as recited in claim 4 wherein said vacuum tank inlet is generally circular in cross-section and has a diameter of approximately three inches, and wherein said vacuum tank outlet is generally circular in cross-section and has a diameter of about 1.5 inches.

6. A system as recited in claim 5 further comprising a quick disconnect coupling operatively attaching said vacuum switch to said vacuum tank so that said vacuum switch extends generally horizontally outwardly from said vacuum tank and adjacent the top thereof.

7. A system as recited in claim 6 wherein said baffle means comprising a generally dome-shaped structure covering said vacuum tank outlet and having openings in side portions thereof.

8. A system as recited in claim 2 wherein said baffle means comprising a generally dome-shaped structure covering said vacuum tank outlet and having openings in side portions thereof.

9. A system as recited in claim 1 wherein said baffle means comprising a generally dome-shaped structure covering said vacuum tank outlet and having openings in side portions thereof.

10. A system as recited in claim 1 further comprising quick disconnect couplings between an inlet for said vacuum tank and said toilet discharge, and between said vacuum tank outlet and conduit between said vacuum tank and said pump.

11. A system as recited in claim 2 wherein said vacuum tank inlet has a cross-sectional area significantly greater than said vacuum tank outlet.

12. A sewage handling system comprising:

a toilet having a discharge portion at the bottom thereof;

a vacuum tank operatively connected to said toilet discharge portion, and having an outlet at the bottom thereof;

a vacuum pump operatively connected by a conduit to said vacuum tank outlet; and baffle means mounted within said vacuum tank and operatively surrounding said vacuum tank outlet, for preventing passage of large, non-degraded objects from the vacuum tank toward the pump, said baffle means comprising a generally dome-shaped element extending into said vacuum tank from the bottom thereof, and having openings at side portions thereof.

13. A system as recited in claim 12 wherein said baffle has means defining two semi-circular shaped openings, disposed on opposite sides of said outlet and having the maximum effective dimension thereof less than the diameter of said vacuum tank outlet, which is generally circular in cross-section.

14. A system as recited in claim 12 wherein said vacuum tank has an inlet having a cross-sectional area significantly greater than said vacuum tank outlet.

15. A system as recited in claim 14 wherein said vacuum tank inlet is generally circular in cross-section and has a diameter of approximately three inches, and wherein said vacuum tank outlet is generally circular in cross-section and has a diameter of about 1.5 inches.

16. A system as recited in claim 12 wherein said vacuum tank is mounted so that it has an inlet directly below said toilet discharge.

17. A system as recited in claim 16 wherein said baffle openings each have a maximum dimension which is less than the diameter of said vacuum tank outlet, said vacuum tank outlet being generally circular in cross-section.

18. A sewage handling system comprising:

a toilet having a discharge portion at the bottom thereof;

a vacuum tank operatively connected to said discharge opening, and having an outlet at the bottom thereof;

a vacuum pump operatively connected by a conduit to said vacuum tank outlet; said toilet having a mechanically operated flush valve associated therewith, opening of said valve allowing in-rushing air to force waste and water from the bowl of the toilet so that the waste fragments as it passes past the valve; and means associated with said vacuum tank for preventing passage of large, non-degraded objects from the vacuum tank toward the pump.

19. A system as recited in claim 18 wherein said vacuum tank has an inlet having a cross-sectional area significantly greater than said vacuum tank outlet.

20. A system as recited in claim 18 further comprising quick disconnect couplings between said vacuum tank inlet and said toilet discharge, and between said vacuum tank outlet and conduit between vacuum tank and said pump.

* * * * *